United States Patent [19]

Phillips

[11] Patent Number: 4,725,845

[45] Date of Patent: Feb. 16, 1988

[54] RETRACTABLE HELICAL ANTENNA

[75] Inventor: James P. Phillips, Lake in the Hills, Ill.

[73] Assignee: Motorola, Inc., Schaumburg, Ill.

[21] Appl. No.: 835,677

[22] Filed: Mar. 3, 1986

[51] Int. Cl.[4] ..... H01Q 1/24; H01Q 1/36

[52] U.S. Cl. ..... 343/702; 343/895

[58] Field of Search ..... 343/702, 745, 749, 750, 343/752, 787, 872, 880, 883, 895, 900, 901

[56] References Cited

U.S. PATENT DOCUMENTS

| | | | |
|---|---|---|---|
| 2,270,514 | 1/1942 | Doane et al. | 343/900 |
| 2,491,629 | 12/1949 | Vernier et al. | 343/901 |
| 2,982,964 | 5/1961 | Bresk et al. | 343/750 |
| 3,104,394 | 9/1963 | Yokoyama | 343/750 |
| 3,226,725 | 12/1965 | Ritchie et al. | 343/745 |
| 3,736,591 | 5/1973 | Rennels et al. | 343/702 |
| 3,737,912 | 6/1973 | Cribb | 343/883 |
| 3,781,899 | 12/1973 | Lockwood | 343/880 |
| 3,836,979 | 9/1974 | Kurland et al. | 343/881 |
| 3,858,220 | 12/1974 | Arnow | 343/802 |
| 4,087,820 | 5/1978 | Henderson | 343/752 |
| 4,121,218 | 10/1978 | Irwin et al. | 343/702 |
| 4,163,981 | 8/1979 | Wilson | 343/715 |

FOREIGN PATENT DOCUMENTS

| | | | |
|---|---|---|---|
| 1190476 | 10/1959 | France | 343/901 |

OTHER PUBLICATIONS

DeMaw, M. F., "Ferromagnetic-Core Design and Application Handbook", 1981, pp. 219–221 and 54.

Miller, J. W., "Industrial Catalog '82".

Pettengill et al., "Receiving Antenna Design for Miniature Receivers", 1977.

*Primary Examiner*—William L. Sikes

*Assistant Examiner*—Michael C. Wimer

*Attorney, Agent, or Firm*—Douglas A. Boehm; Charles L. Warren; Donald B. Southard

[57] ABSTRACT

A retractable antenna assembly is disclosed for tuning an antenna having a helical section to frequency by selectively positioning an appropriate tuning core within the helix. The antenna frequency can either be raised or lowered through the use of conductive or permeable tuning core compositions. The core positioning mechanism is implemented by affixing the tuning core to a portion of the antenna supporting rod slideably located within the helix. This helical antenna/tuning core configuration is readily adaptable to miniature portable radios by providing a helical antenna assembly which is retractable within the radio housing in the receive-only or standby mode, and which is outwardly extendible from the radio housing for use in the active transmit/receive mode. A unique barrel-cam latching mechanism is also described.

25 Claims, 9 Drawing Figures

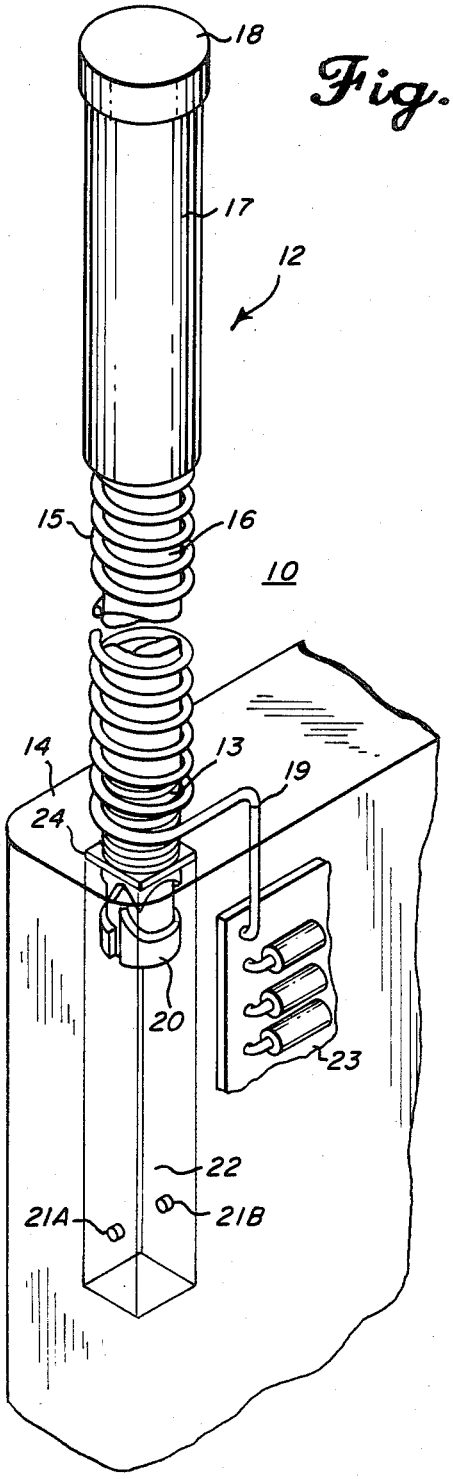
Fig. 1
Fig. 2
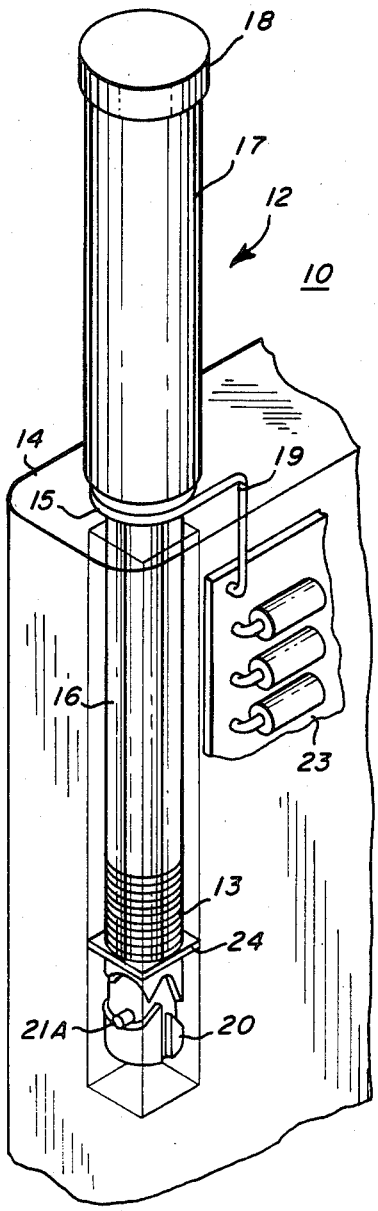

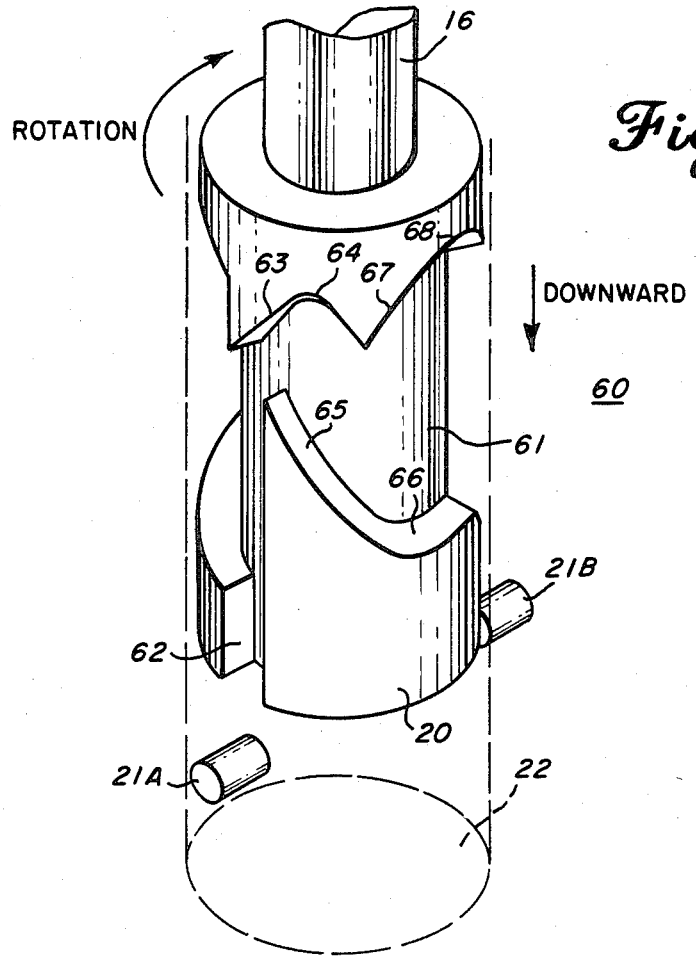
Fig. 6
Fig. 7
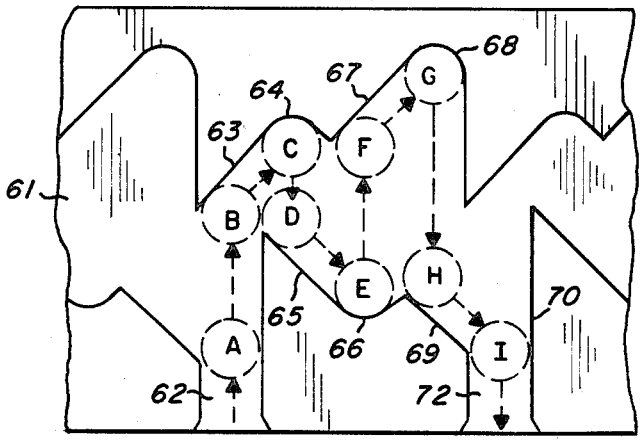

RETRACTABLE HELICAL ANTENNA

BACKGROUND OF THE INVENTION

The present invention generally relates to the field of antennas, and more particularly to a retractable helical antenna designed for use with miniature portable radio transceivers.

Until recently, two-way portable radios have primarily utilized monopole antennas, which are usually deployed from a retracted storage position to an extended operating position. For frequencies in the VHF range (30 MHz. to 300 MHz.), a monopole antenna must be extended on the order of two feet to efficiently transmit. Not only is this antenna-deploying procedure inconvenient to the user, but also possibly dangerous under some circumstances. Moreover, with the continuing trend to make portable radio equipment smaller, there has been a corresponding interest in size-reduction for portable antennas. For example, in a portable "shirt-pocket" radio, where the entire radio case measures only five inches in height, a two-foot antenna is considered highly impracticable.

These reasons illustrate why helical antennas have now become very popular antenna configurations for portable radios. The helical shape of the antenna is attractive for mechanical reasons, since it generally requires only 1/10th of the height of a monopole at the same frequency. Additionally, the helical antenna provides excellent electrical characteristics, such as efficiencies on the order of 60%. Furthermore, some helical antennas are easily compressed into even a smaller size for storage. A collapsible configuration is described in U.S. Pat. No. 3,836,979 for an axial mode helical antenna.

Helical antennas are operated in different modes for different applications. To obtain the most compact antenna, the helix is operated in the normal mode. In the normal radiation mode, the diameter of the helix is a small fraction of the wavelength and the electrical length is less than one wavelength. Typically, portable radio helical antennas have an electrical length of less than one-fourth wavelength. However, in the normal mode, the frequency bandwidth of the helical antenna is quite narrow. Hence, the potential uses for helical antennas have previously been limited to applications where a narrow bandwidth is acceptable, such as simplex (single-frequency) radio systems.

This frequency bandwidth limitation of helical antennas have had a significant impact on the size-vs.-performance tradeoff of portable radio design. Portables often operate through repeaters for a wide-area coverage. In such repeater applications, these portable radios transmit on one frequency and receive on another, usually widely-spaced from the first. The wide Tx/Rx frequency spacing necessitates that a performance compromise be made for helical antennas—between optimal antenna efficiency at the transmit or receive frequency. In the alternative, a dual antenna configuration, such as the monopole/helix arrangement described in U.S. Pat. No. 4,121,218, may be provided. However, this approach contradicts the size-minimization and cost-reduction goals of most portable products.

Another approach to the size/performance problem of helical antennas is to tune the antenna over the desired frequency range by changing the fraction of the total helix used as the antenna portion. This can be accomplished by either shorting-out the unused portion of the helix via sliding contacts as shown in U.S. Pat. No. 4,087,820, or by varying the number of turns in the expanded section of the helix, as described in U.S. Pat. No. 3,858,220. Both of these prior art antennas have mechanical limitations which make it very difficult to implement and highly unattractive for use with miniature portable transceivers at VHF frequencies. Moreover, these prior methods of tuning helical antennas would prove to be too awkward and intricate for portable radio applications requiring repeated tuning to widely-spaced transmit and receive frequencies.

Therefore, a need exists for an antenna which can be easily tuned to frequency and readily adapted to portable radio transceiver applications.

SUMMARY OF THE INVENTION

Accordingly, it is an object of the present invention to provide an antenna which overcomes the aforementioned difficulties concerning antennas used with portable radios.

Another object of the present invention is to provide an improved means for tuning an antenna having a helical section to frequency.

Yet another object of the present invention is to provide a retractable helical antenna for a portable radio which can be readily tuned to wide-spaced receive and transmit frequencies.

It is a further object of the present invention to provide an improved latching mechanism for such a retractable helical antenna.

In accordance with the present invention, there is provided a means for tuning an antenna having a helical section to frequency by selectively positioning an appropriate tuning core within the helix. If the tuning core material is highly conductive, the effect of inserting the core within the helix is to raise the antenna frequency; whereas if the core material is highly permeable, the antenna frequency will be lowered. Hence, the helical antenna can be selectively tuned between at least a first and a second frequency. This core-tuning procedure for helical antennas can be readily implemented by affixing the tuning core to a portion of the antenna supporting rod slideably engaged within the helix, such that the core can easily be positioned at a predetermined location within the helix.

The present embodiment illustrates how this helical antenna/tuning core configuration is particularly adaptable to miniature portable radios having widely-spaced transmit and receive frequencies. The helical antenna supporting rod and tuning core are positioned such that they can be retracted into the radio housing in the receive-only, or standby mode, and outwardly extended from the radio housing for use in the transmit/receive, or active mode. As a result, the tuning core is only positioned within the helix during the active mode, which facilitates tuning the antenna for the transmit frequency independently of tuning for the receive frequency in the standby mode. Furthermore, a novel barrel-cam latching mechanism is also described which provides a push-to-retract/push-to-extend antenna operation to permit one-hand operational convenience.

BRIEF DESCRIPTION OF THE DRAWINGS

Additional objects, features, and advantages in accordance with the present invention will be more clearly understood by way of unrestricted example from the following detailed description taken together with the accompanying drawings in which:

FIG. 1 is a perspective view of a retractable VHF helical antenna according to the present invention, shown in the extended position;

FIG. 2 is a perspective view illustrating the antenna of FIG. 1 shown in the retracted position;

FIG. 6 is a perspective view of the barrel-cam latching mechanism of the preferred embodiment;

FIG. 7 is a planar diagram in two dimensions representing the face of the barrel-cam of FIG. 6, showing the latching mechanism operation;

DESCRIPTION OF THE PREFERRED EMBODIMENT

Figure 3:
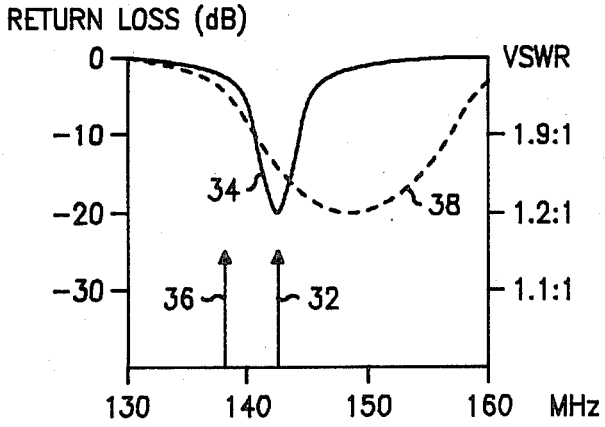
FIG. 3 is a graph of the return loss of a helical antenna in the retracted and extended positions.

Referring now to FIGS. 1 and 2, perspective views of the retractable antenna of the present invention are shown. Specifically, FIG. 1 illustrates portable radio transceiver 10 including helical antenna 12 in the extended position, i.e., coiled spring 15 in an expanded configuration, having the tuning core 13 located within the helix. In this position, the antenna is tuned for a first operating frequency, typically the radio transmit frequency used in the active mode. Conversely, in FIG. 2, antenna 12 is shown in the retracted position, i.e., coiled spring 15 in a compressed configuration wherein tuning core 13 is positioned below the helix such that it has no effect on the antenna's resonant frequency. The retracted position of FIG. 2 is typically representative of the standby mode, wherein the antenna is tuned to a receive frequency. Hence, the antenna performance between the active and standby modes is no longer compromised to accommodate both transmit and receive frequencies.

Antenna 12 is a vertically polarized normal mode helical antenna in which the ground plane is approximated by the ground of the portable radio. Although a helical antenna is illustrated herein, it will be apparent that the entire antenna need not be helical in order to practice the present invention. The helix is made of highly conductive spring wire 15 covered with insulating material. Non-ferrous spring wire is preferred, since ferrous materials (steel, etc.) are unsuitable for the antenna due to their low conductivity. Additionally, plating the steel to increase its conductivity would not be practical since the flexing of the spring could cause the plating to crack. The length of the helical wire is selected such that the antenna will resonate at the receive frequency in the retracted position (FIG. 2). The diameter of wire 15 is chosen to provide a sufficient spring force to raise and hold antenna 12 in the extended position, without requiring too great a force to be applied to retract the antenna. The lower end of the spring helix closest to radio housing 14 is mechanically attached to the housing at point 19, and electrically connected to radio transceiver circuitry 23. The other end of the helix can be mechanically affixed to the opposing end of rod 16 in any appropriate manner, or its movement may be mechanically restricted by the use of top cap 18 located as shown.

The antenna wire is wound helically about dielectric (insulative) rod 16, which is coincident with the longitudinal axis of the helix, and which extends into cavity 22 of radio housing 14. The diameter of rod 16 is slightly smaller than the inside diameter of the helix, such that wire 15 is free to slide on the rod. However, in the retracted position of FIG. 2, top cap 18 prevents the far end of the helix from being detached under the compressed spring force. Additionally, in the retracted position, the insulative coating on the wire prevents adjacent turns from shorting together. Rod 16 acts as an internal guide to support the helical spring in an upright position. The rod may be solid or hollow, depending upon the latching mechanism and tuning core positioning configurations. Furthermore, the rod may be flexible if desired.

Figure 8:
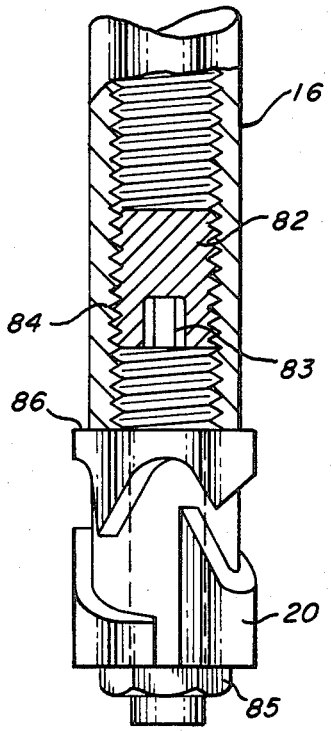
FIG. 8 is a partial view of the antenna rod of FIG. 1 illustrating an alternate embodiment of a core-positioning mechanism.

Tuning core 13 is located affixed to the end of rod 16 opposite top cap 18. Tuning core 13 itself can have numerous possible configurations. FIG. 2 illustrates that the preferred embodiment utilizes a stack of eleven individual toroids having an outer diameter approximately equal to the diameter of rod 16. Alternatively, the tuning core may be configured as a separate cylindrical portion of the rod itself, or may have the shape of a setscrew as shown in FIG. 8. The toroid shape, however, is very convenient, since it allows a reduced-diameter section of rod 16 to pass through the core and act as an axis for rotating barrel-cam 20 described later. Furthermore, since high permeability material suitable for VHF frequencies is very brittle and too mechanically weak to withstand stresses, the preferred arrangement of the dielectric rod passing through the toroid-shaped cores provides the necessary mechanical support.

Mechanical stop 24 is mounted to rod 16 below tuning core 13 such that the stop contacts radio housing 14 to limit the extension of the antenna. The exact configuration of stop 24 would be dependent upon the particular radio housing and cavity construction. A flat, round washer, having an outer diameter slightly larger than the diameter of rod 16 and core 13, may be readily implemented. However, in the preferred embodiment, a square washer, having outer side dimensions equal to the rod diameter and having an inner hole diameter equal to the reduced-diameter section of the rod, is used as mechanical stop 24. Accordingly, cavity 22 would exhibit a square cross-section, having side dimensions slightly larger than the rod and washer outer dimensions to allow the square washer to slide within the cavity. This square washer/square cavity configuration requires less wasted cavity volume than a round cavity configuration—an important consideration in miniature radio design. Further, it also provides better mechanical support when retracting the antenna, since the entire length of the round rod contacts the four walls of the square cavity along four lines parallel to the rod's longitudinal axis, in addition to contacting the edge of the washer.

The lower end of the dielectric rod is retracted within the radio housing into cavity 22 when the antenna is in the standby mode. A latching mechanism, such as rotatable barrel-cam 20, is located below mechanical stop 24. The barrel-cam may be secured to the rod by a nut (shown as 85 of FIG. 8). Barrel-cam 20 interacts with pins 21*a* and 21*b*, which are secured to the inside wall of cavity 22, to retain rod 16 in the retracted position. In the preferred embodiment, the antenna is changed from the retracted to the extended position by pressing on top cap 18 to trigger the latch mechanism, and then releasing the pressure to allow the helical spring force to extend the antenna. This procedure is identical to change from the extended to the retracted position. A further description of the latching mechanism is provided later.

An antenna cover may be advantageously used to protect the turns of the helix at least when the antenna is in the retracted position. Cover 17, as shown in FIGS. 1 and 2, should be of sufficient length to extend over the exposed turns of the helix in the retracted position, yet should be short enough to allow proper operation of the latching mechanism. In the alternative, a continuous-length cover may be used to protect the helix in both the extended and retracted positions—but it is in the retracted position that the helix is most likely to be damaged when placed in a person's shirt pocket. Cover 17 is made of dielectric material having an inner diameter sufficient to allow the helical spring to slide within it. Cover 17 may be rigid or flexible, depending on the particular application.

In operation, the user would normally have the miniature portable radio located in his shirt pocket, with the antenna in its retracted position (i.e., FIG. 2). In this standby mode, the helical antenna is tuned for the receive frequency, allowing the user to continuously monitor the RF channel for a message. For most portable applications, the radio never transmits in this standby mode. Hence, the antenna performance at the transmit frequency is inconsequential, and the antenna parameters can be optimized for receiving. Furthermore, the proximity effects of being carried near the body can also be taken into account when optimizing the antenna for the receive frequency. This receive-only helical antenna position is not suitable for both transmit and receive applications, due to its very narrow frequency bandwidth.

In the active mode, the radio is removed from the user's pocket or holster and held in his hand in order to locate the microphone near the user's mouth or the earphone near his ear. When the portable radio is in the user's hand, there is less need for a small antenna size—while antenna efficiency for transmitting becomes significantly more important. For this reason, the user extends the antenna for the transmit mode. When the user deactivates the latching mechanism, the spring force of the helix pushes the antenna rod outward from the radio case until the mechanical stop limits its travel. This is defined as the extended position of the antenna. In the extended position, the tuning core is automatically positioned within the lower end of the helix. With the insertion of the tuning core, the helical antenna becomes tuned to the transmit frequency while the bandwidth is simultaneously increased. In this position, the antenna is much more efficient at the transmit frequency. Although tuned to the specific transmit frequency, the antenna now exhibits a frequency bandwidth broad enough to effectively cover the receive frequency. Also by being removed from the user's pocket, the antenna will now be in a more advantageous physical location to perform better at the receive frequency, even though it has been optimized for the transmit frequency.

The efficiency of the antenna in each position can be calculated by comparing the radiation resistance with the loss resistance. In the retracted position of FIG. 2, antenna 12 of the preferred embodiment (exact dimensions furnished later) has a 15% efficiency for receive frequencies. In the extended position of FIG. 1, the antenna has a 56% efficiency for transmit frequencies. By analogy, a typical fixed-length helical antenna designed in accordance with the prior art occupies nine times the volume and four times the height of antenna 12 in the retracted position, while it exhibits only a slightly improved 78% efficiency. Hence, while the performance of the two antennas is comparable, the retractable antenna configuration of the present invention is much more convenient.

Figure 4:
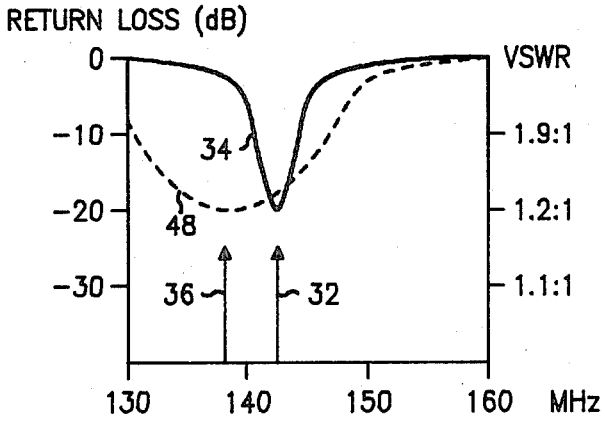
FIG. 4 is a graph similar to FIG. 3 showing the effects on frequency and bandwidth of inserting a highly permeable tuning core within the helical antenna.
Figure 5:
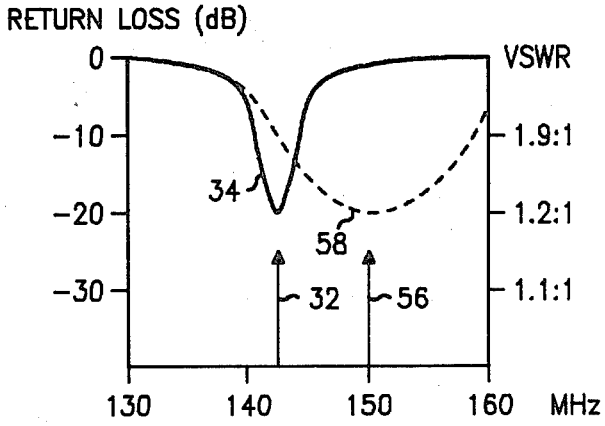
FIG. 5 is a graph similar to FIG. 4 illustrating the opposite effects of using a highly conductive tuning core.

FIGS. 3, 4, and 5 illustrate the effect of various tuning cores on the antenna in both positions of FIGS. 1 and 2. Specifically, FIG. 3 shows the return loss in (decibels) and the voltage standing wave ratio (VSWR) as a function of frequency (in MHz) for antenna 12 without any tuning core. If the helical antenna in the retracted position (shown as in FIG. 2) was optimized for the standby mode, the antenna would exhibit a frequency response shown as 34, having a high return loss of approximately −20 dB and a very narrow operational frequency bandwidth at receive frequency 32. However, the desirable region of high return loss, shown as 38, moves higher in frequency and gets wider in bandwidth as the antenna is extended. This effect is predicted by classical antenna design theory.

The increase in the center frequency of the operation is due to a decrease in the inductance as the turns of the helix are separated. The total inductance of the helix is equal to the self-inductance of each turn plus the sum of the mutual inductances of all turns:

$$L_t = L_1 + L_2 + L_3 + \ldots + M_{12} + M_{13} + \ldots M_{21} + M_{23} + \ldots$$

where $L_t$ is the total inductance of the helix, and M is the mutual inductance between pairs. As the helix is extended, the mutual inductance between the turns decreases, and therefore the total inductance decreases.

The resonant frequency of the antenna can be described as:

$$F_0 = 1/[2\pi\sqrt{L_t C}\,]$$

where $L_t$ is the total inductance of the antenna, and C is the capacitance of a short antenna. Hence, it can be seen that the resonant frequency of the antenna increases as the inductance decreases due to the separation of the helix turns.

Furthermore, since the bandwidth is a function of the frequency and coupling between the turns of the helix, it can be shown that the frequency bandwidth increases as the antenna is extended. The relationship is:

$$\text{Bandwidth} = F_o/Q = F_o/[X_c/R_r] = F_o R_r/X_c$$

where $X_c$ is the capacitive reactance and where $R_r$ is the radiation resistance. The radiation resistance of a resonant helix above a perfect ground plane can be described as:

$$R_r = [25.3(h)/\lambda]^2$$

where $R_r$ is the radiation resistance in ohms, h is the height of the helix, and λ is the wavelength. Hence, the increase in antenna height produces a corresponding increase in radiation resistance of the antenna. This, in turn, produces a lower Q, thus resulting in a wider bandwidth.

If, however, it is desired that the antenna operate at the same, or perhaps even a lower frequency in the extended position, (i.e., shown as transmit frequency 36 in FIG. 3), then the antenna's inherent tendency to increase in frequency in the extended position (response 38) becomes counterproductive. Antenna 12 exhibits an operational frequency band—defined as all frequencies having less than a 2:1 VSWR—for receive frequency 32 (in the retracted position) which does not include transmit frequency 36. Hence, some additional inductance must be added to the antenna to lower its frequency. This additional inductance is provided by inserting a highly permeable tuning core within the lower turns of the helical spring. The particular composition of the core material will be discussed later.

FIG. 4 illustrates the effect of inserting a tuning core of a high permeability material into the helix in the extended position. The permeable core material increases inductance of the helix so as to lower the resonant frequency of the antenna. The amount of frequency change is proportional to the amount and permeability of the tuning core. The corresponding return loss frequency response 48 (in the extended position) shows that the highest return loss (lowest VSWR) is now centered at transmit frequency 36. Furthermore, since the antenna naturally exhibits a broader bandwidth in the extended position, the antenna performance is adequate at receive frequency 32. Hence, the antenna is now configured for both transmit and receive operation in the extended position, while it is configured for receive-only operation in the retracted position.

FIG. 5 illustrates the effect of using a tuning core of a highly conductive material. If, for example, the natural increase in antenna frequency in the extended position is insufficient, a tuning core of conductive material can be used to provide a further increase in frequency. As shown in FIG. 5, the center frequency of return loss response 58 has been increased from that of response 38 (FIG. 3) due to the insertion of a brass core inside the helix. Again note that the broad bandwidth of response 58 covers receive frequency 32 at less than a 2:1 VSWR. Any highly conductive and non-magnetic core material may be used. For example, a brass or copper core of an appropriate size may be advantageously utilized to provide such an increase in frequency.

As previously noted, highly permeable core material is used to lower the antenna frequency, while highly conductive material is used to raise the antenna frequency. The core material is selected as a function of the desired frequency shift and the required transmitter power output. Highly permeable magnetic materials are subject to saturation if operated in too strong of a magnetic field. In the low-power portable transmitter of the preferred embodiment, numerous readily available permeable materials may be used for the tuning core. For example, a ferrite core (powdered iron mixed with clay) having a relative permeability of 8 has provided good results in lowering the antenna frequency 10 MHz. at 150 MHz. The low (one watt) transmit power of a typical portable is not enough to drive the core material into a non-linear condition. Specifically, antenna 12 exhibits a measured H-field intensity of approximately 0.7 Orsteads, with a flux density of 3.7 Gauss. Under these conditions, the core material performs linearly. Furthermore, with the low permeability material used, the temperature coefficient of 35 ppm/°C. results in a negligible temperature drift. However, at power levels in excess of ten watts, the permeable core material must be selected for its linearity in strong magnetic fields. The core material must also be selected for low hysteresis and eddy current losses at the required frequency.

The mechanical operation of the retractable antenna of the present invention allows one-hand operation while holding the radio in almost any position. This feature is accomplished by a unique latching mechanism which restrains the helical spring in the compressed position. The small size of a portable radio dictates that a very small latching mechanism be implemented. Since miniature portable radios generally have very limited surface area for controls, an internal latching mechanism such as provided by the preferred embodiment is highly desirable. Although this exact type of latch is not essential to the basic core-tuning procedure of the present invention, it does, however, add operational convenience to the radio because no external buttons or controls are needed to work the latching mechanism. The preferred embodiment also provides a latching mechanism which cannot be accidentally triggered to suddenly shoot out.

The push-to-retract/push-to-extend operation of the antenna latching mechanism of the present invention resembles that of a typical retractable ballpoint pen, but the amount of travel required between the extended and retracted positions (two inches of antenna travel versus 0.125 inches of travel for a pen) and the requirements for portable radio miniaturization (shirt-pocket size) excluded the use of prior art mechanisms.

Referring now to FIG. 6, a detailed perspective view of latching mechanism 60 is illustrated. Pin-following barrel-cam 20 is rotatably mounted to the end portion of rod 16 located inside the radio housing. Although not illustrated in this partial view, tuning core 13 would be affixed to rod 16 above cam 20. Pins 21*a* and 21*b* are secured to the inside walls of radio housing cavity 22. These pins 21*a* and 21*b* interact with slots 62 and 72 in barrel-cam 20 to cause the antenna rod 16 to latch and retain the helical antenna in the retracted position. The antenna is changed from the retracted position to the extended position by pressing downward on antenna top cap 18 until a stop is felt, and then releasing the pressure to allow the antenna to extend outwardly under the force of the helical spring. The procedure is identical to change from the extended to the retracted position. The antenna positioning operation may be performed by using a single finger (or the thumb) while still holding the radio housing in the same hand. Hence, a one-hand push-to-retract/push-to-extend antenna operation is created.

The operation of latching mechanism 60 can best be understood by the two-dimensional diagram of FIG. 7. This diagram represents the face of the barrel-cam projected onto a flat surface. The circles A through I of FIG. 7 represent the various positions of either pin 21*a* or 21*b* following channel 61 in cam 20 as the cam rotates. The pin appears to move from left to right by way of positions A through I as the antenna is operated through one retracting/extending cycle. Since the barrel-cam is bilaterally symmetric, the operational sequence will be identical for pins 21*a* and 21*b*. For brevity, only the latching sequence for pin 21*a* will be described, with it being understood that the sequence for 21*b* is identical. It should be noted that the stationary frame of reference for FIG. 7 (the barrel-cam itself) is different from the actual frame of reference (the radio housing and pins) of FIG. 6. However, it is believed that a better explanation can be provided with such a diagram.

When the antenna is pressed downward into the radio housing, pin 21*a* enters channel 62 in cam 20 at position A. The pin then contacts channel wall 63 at position B which causes the cam to rotate 45° as the antenna continues downward. A stop point C is reached at wall 64, and the downward pressure on the antenna should now be released. The spring force of the helix pushes the antenna upward until channel wall 65 contacts pin 21*a* at position D. The spring continues to push the rod upward until cam 20 has rotated another 45° to position E. The antenna is now latched in the retracted position at position E adjacent to channel wall 66.

To go from the retracted antenna position to the extended position, a similar sequence occurs. A downward force is initially applied to the antenna top cap which causes pin 21*a* to move upward until channel wall 67 is contacted at position F. Further downward travel of the antenna causes cam 20 to rotate another 45° until wall 68 is contacted. The antenna is now at the downward stop position G. At this time, the downward force on the antenna should be released. The spring force of the helix then pushes the antenna rod upward until pin 21*a* contacts wall 69 at position H. As the antenna continues to move upward under the spring force, cam 20 rotates still another 45° to position I at wall 70, where the pin is free to disengage from the cam via channel 72. The antenna now continues traveling upward to the fully extended position shown in FIG. 1. An appropriate upward travel mechanical stop should be provided to fix the exact position of the rod and core within the helix. As we have seen, the push-to-retract-/push-to-extend latching mechanism of the present invention provides the preferred one-hand operation in a severely restricted environment.

FIG. 8 is a partial cross-sectional view illustrating an alternate embodiment of the core-positioning mechanism of the present invention. In this embodiment, antenna rod 16 is of a hollow construction having internal threads 84. Tuning core 82 exhibits the shape of a setscrew having a hexagonal internal socket 83 adaptable for use with a tuning tool. Using this configuration, the frequency of the helical antenna can be adjusted over a continuous range by linearly varying the amount of core material positioned within the helix. If desired, a number of tuning cores 82 may be inserted within rod 16 to provide multiple cores for tuning more than one frequency. In such a case, the latching mechanism should provide an equal number of discrete core positions. For example, five separate tuning cores, each spaced apart from the next, could provide tuning for five different transmit (or receive) frequencies. An appropriate latching mechanism, such as barrel-cam 20, may be attached to the lower portion of the rod with nut 85 as shown. FIG. 8 also illustrates that if the diameter of rod 16 is slightly less than that of barrel-cam 20, then ledge 86 may provide a different embodiment of mechanical stop 24.

Figure 9:
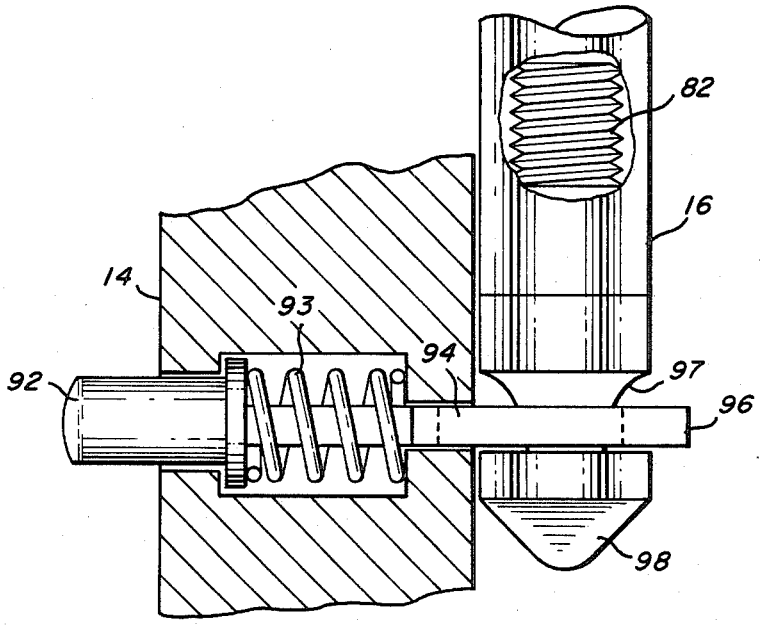
FIG. 9 is a partial view showing an alternate embodiment of an appropriate latching mechanism.

FIG. 9 is an alternate embodiment of a latching mechanism adaptable for use with the present invention for use in an environment which is not as restricted. This figure shows a simplified, quick-release type catch utilizing an external button. Antenna rod 16, possibly having tuning core 82 mounted within, is manually depressed into radio housing 14 by the operator. When tip portion 98 contacts lever 94, finger 96 would be forced away from rod 16 until it latches into neck 97 under the force of spring 93. The radio operator simply presses button 92 to release the antenna, still allowing for one-hand-operation. This button can simultaneously activate the radio push-to-talk switch, since both operations occur in the transmit mode. It may, however, be somewhat dangerous to allow a sudden unrestricted extension of the antenna. Therefore, it could prove advantageous to provide for an extension damping mechanism, such as a snug-fitting O-ring around the antenna rod at the top of the cavity. It is also contemplated that the core tuning procedure of the present invention may be implemented in a helical antenna without any latching mechanism whatsoever. In this case, radio housing cavity 22 should be designed to provide a friction fit with antenna rod 16. The operator would then manually pull the antenna out of the radio housing for the transmit mode, and manually push it in for receive. Furthermore, if multiple antenna positions are desired to accommodate multiple radio frequencies, a series of legend lines encircling rod 16 may be provided. The operator could then position the tuning core (or cores) within the helix at the appropriate location corresponding to the desired radio frequency. The latching mechanism may alternatively be designed to have a number of discrete latching positions to correspond to a number of separate tuning cores.

The retractable helical antenna of the preferred embodiment is used with a portable radio transceiver operating at approximately 150 MHz for transmit and approximately 160 MHz for receive, and having a power output below one watt. The external antenna height is approximately one and one-eighth inches in the retracted position, and approximately three and one-half inches in the extended position. The dielectric rod is 0.187 inches in diameter, and comprised of glass-loaded polycarbonate. The antenna wire is a beryllium copper alloy precipitation, work-hardened to full hardness. The wire is 0.014 inches in diameter and covered with 0.001 inches of Formvar plastic insulation. Forty-six turns of wire are required for an total uncoiled length of 27 inches. The tuning core is made from a stack of 11 toroids, each measuring 0.182 inches OD, 0.103 inches ID, and 0.040 inches in height. These toroids are available from Arnold Engineering as part number FE0182-0600. The antenna cover is an epoxy-fiberglass tube having a wall thickness of 0.015 inches and a 0.022 inch ID. The cover extends from the antenna top cap to within approximately 0.1 inch of the radio housing to allow for the proper operation of the push-to-retract-/push-to-extend latching mechanism.

While specific embodiments of the present invention have been shown and described herein, further modifications and improvements may be made by those skilled in the art. All such modifications which contain the basic underlying principles disclosed and claimed herein are within the scope of this invention.

What is claimed is:

1. An antenna assembly capable of being tuned to at least two desired operating frequencies comprising:

a helical antenna comprised of insulated wire having at least a portion encircling the longitudinal axis of a helix to form a coiled spring which is adjustable between a compressed configuration and an expanded configuration by changing the separation distance between turns of the helix, said helical antenna having a first operational frequency and bandwidth in said compressed configuration and having a second operational frequency and bandwidth in said expanded configuration which is substantially different from the first;

core tuning means capable of being selectively positioned within said helix for tuning the resonant frequency of said helical antenna; and means for fixedly positioning said core tuning means within said helix at a predetermined location only when said helix is in said expanded configuration, said predetermined location corresponding to one of said desired operating frequencies of said antenna assembly.

2. The antenna assembly according to claim 1, wherein said helical antenna operates in a normal radiation mode to receive vertically polarized radio frequency waves.

3. The antenna assembly according to claim 1, wherein said second operational frequency is not within said first operational bandwidth.

4. The antenna assembly according to claim 1, further comprising:

housing means for supporting said helical antenna, said housing means having a cavity therein; and mounting means including a dielectric rod slideably engaged within said housing cavity and within said helix, said dielectric rod having a longitudinal axis oriented such that said helical antenna extends outwardly from said housing means.

5. The antenna assembly according to claim 4, wherein said mounting means includes means for adjusting said coiled spring from the compressed configuration to the expanded configuration simultaneously when said core positioning means positions said core tuning means within said helix.

6. The antenna assembly according to claim 1, wherein said core positioning means includes means for retaining said coiled spring in the compressed configuration.

7. The antenna assembly according to claim 6, wherein said retaining means provides one-hand operation capability to change between the compressed and expanded configurations.

8. The antenna assembly according to claim 1, wherein said core tuning means is comprised of a plurality of toroid-shaped tuning elements arranged in a single stack having their combined central axes coincident with the longitudinal axis of said helix.

9. The antenna assembly according to claim 1, wherein said core tuning means has no substantial effect on the operational bandwidth of the helical antenna when positioned within said helix.

10. The antenna assembly according to claim 5, wherein said core positioning means defines two fixed positions corresponding to said two desired operating frequencies, a first position corresponding to the compressed configuration and a second position corresponding to the expanded configuration.

11. A radio transceiver having an antenna capable of being tuned to at least two predetermined frequencies, said radio transceiver comprising:

radio housing means for supporting said antenna, said housing means having a cavity therein;

a helical antenna comprised of insulated wire having at least a portion encircling the longitudinal axis of a helix to form a coiled spring which is adjustable between a compressed configuration and an expanded configuration by changing the separation distance between turns of the helix, said helical antenna having a first operational frequency and bandwidth in said compressed configuration and having a second operational frequency and bandwidth in said expanded configuration which is substantially different from the first;

core tuning means capable of being selectively positioned within said helix for tuning the resonant frequency of said helical antenna; and means for fixedly positioning said core tuning means within said helix at a predetermined location corresponding to one of said predetermined frequencies while simultaneously adjusting said coiled spring from the compressed configuration to the expanded configuration.

12. The radio transceiver according to claim 11, wherein said helical antenna operates in a normal radiation mode to receive vertically polarized radio frequency waves.

13. The radio transceiver according to claim 11, wherein said core positioning means includes a dielectric rod slideably engaged within said housing cavity and within said helix, said dielectric rod having a longitudinal axis oriented such that said helical antenna extends outwardly from said housing means.

14. The radio transceiver according to claim 13, wherein said core positioning means fixedly positions said core tuning means at two predetermined locations, a first location being exterior to said helix when said rod is substantially retracted into said radio housing cavity such that said coiled spring is in the compressed configuration, a second location being interior to said helix when said rod is substantially extended from said radio housing cavity such that said coiled spring is in the expanded configuration.

15. The radio transceiver according to claim 11, wherein said second operational frequency is not within said first operational bandwidth.

16. The radio transceiver according to claim 14, wherein said two predetermined locations correspond to a receive frequency and a transmit frequency of said radio transceiver, respectively.

17. The radio transceiver according to claim 13, wherein said core positioning means includes means for latching said dielectric rod substantially within said radio housing cavity such that said coiled spring is retained in the compressed configuration.

18. The radio transceiver according to claim 17, wherein said latching means provides one-hand operation capability to change between the compressed and expanded configurations.

19. The radio transceiver according to claim 17, wherein said latching means includes a rotatable barrel-cam and associated pins mounted within said cavity.

20. The radio transceiver according to claim 13, wherein said core tuning means is comprised of a plurality of toroid-shaped tuning elements arranged in a single stack having their combined central axes coincident with the longitudinal axis of said rod.

21. The radio transceiver according to claim 11, wherein said core tuning means has no substantial effect on the operational bandwidth of the helical antenna when positioned within said helix.

22. A radio transceiver having a normal mode helical antenna which is capable of being tuned to at least two predetermined radio transceiver frequencies, said radio transceiver comprising:

a radio housing having a cavity and containing radio transceiver circuitry:

a dielectric rod slideably engaged within said cavity, said rod having a tip portion extending outwardly from said radio housing;

an insulated wire conductor loosely encircled around said rod and formed in the shape of a coiled spring to create a helical antenna, a first end of said wire affixed to said tip portion of said rod, the second end of said wire electrically connected to said radio transceiver circuitry, said coiled spring being adjustable between a compressed configuration and an expanded configuration;

a tuning core capable of being selectively positioned within said coiled spring, said tuning core having an effect on the resonant frequency of said helical antenna when positioned within said coiled spring; and core positioning means attached to said rod for fixedly positioning said tuning core within said coiled spring at a predetermined location associated with a particular helical antenna resonant frequency while simultaneously adjusting said coiled spring from the compressed configuration to the expanded configuration, whereby the extension of said rod from said radio housing alters the resonant frequency of said helical antenna to correspond to one of said predetermined radio transceiver frequencies.

23. The radio transceiver according to claim 22, wherein said core positioning means fixedly positions said tuning core at two predetermined locations, a first location being exterior to said helical antenna when said rod is substantially retracted into said radio housing cavity such that said coiled spring is in the compressed configuration, a second location being interior to said helical antenna when said rod is substantially extended from said radio housing cavity such that said coiled spring is in the expanded configuration.

24. The radio transceiver according to claim 23, wherein said two predetermined locations correspond to a receive frequency and a transmit frequency of said radio transceiver, respectively, and wherein the transmit frequency is not within the operational bandwidth of said helical antenna operating in the retracted position.

25. The radio transceiver according to claim 22, wherein said core positioning means provides one-hand operation capability to change between the compressed and expanded configurations.

* * * * *